US011187463B2

(12) United States Patent
Kim

(10) Patent No.: US 11,187,463 B2
(45) Date of Patent: Nov. 30, 2021

(54) APPARATUS AND METHOD FOR CONTROLLING CONCENTRATION OF OXYGEN IN HEATING FURNACE

(71) Applicants: POSCO, Pohang-si (KR); RESEARCH INSTITUTE OF INDUSTRIAL SCIENCE & TECHNOLOGY, Pohang-si (KR)

(72) Inventor: Young-Il Kim, Pohang-si (KR)

(73) Assignees: POSCO, Gyeongsangbuk-Do (KR); RESEARCH INSTITUTE OF INDUSTRIAL SCIENCE & TECHNOLOGY, Gyeongsangbuk-Do (KR)

( * ) Notice: Subject to any disclaimer, the term of this patent is extended or adjusted under 35 U.S.C. 154(b) by 282 days.

(21) Appl. No.: 16/470,732

(22) PCT Filed: Dec. 20, 2017

(86) PCT No.: PCT/KR2017/015084
§ 371 (c)(1),
(2) Date: Jun. 18, 2019

(87) PCT Pub. No.: WO2018/117625
PCT Pub. Date: Jun. 28, 2018

(65) Prior Publication Data

US 2019/0346206 A1 Nov. 14, 2019

(30) Foreign Application Priority Data

Dec. 20, 2016 (KR) ..... 10-2016-0174801

(51) Int. Cl.
*F27D 19/00* (2006.01)
*F27D 21/04* (2006.01)

(52) U.S. Cl.
CPC ..... *F27D 21/04* (2013.01); *F27D 19/00* (2013.01); *F27D 2019/0028* (2013.01)

(58) Field of Classification Search
CPC .. F27D 19/00; F27D 21/04; F27D 2019/0015; F27D 2019/0028
See application file for complete search history.

(56) References Cited

U.S. PATENT DOCUMENTS 3,475,599 A * 10/1969 Schwartzenberg ..... C21C 5/30 700/207
2009/0253090 A1* 10/2009 Seo ..... C21D 11/00 432/37
2016/0304977 A1 10/2016 Kamikawa et al.

FOREIGN PATENT DOCUMENTS

JP 5-79622 A 3/1993
JP 2015-113484 A 6/2015
(Continued)

OTHER PUBLICATIONS

Search Report issued in corresponding International Application No. PCT/KR2017/015084, dated Apr. 17, 2018.

*Primary Examiner* — Scott R Kastler
(74) *Attorney, Agent, or Firm* — Morgan, Lewis & Bockius LLP

(57) ABSTRACT

An apparatus for controlling the concentration of oxygen in a heating furnace according to one embodiment of the present invention may comprise: a first oxygen concentration bias setting unit for receiving a set first oxygen concentration bias; a second oxygen concentration bias calculation unit for, when a measured value of carbon monoxide in exhaust gas is out of an allowable carbon monoxide range, calculating a second oxygen concentration bias by using the measured value of carbon monoxide and the concentration of oxygen measured in the exhaust gas; an oxygen concentration bias providing unit for providing an oxygen concen-
(Continued)

tration bias by using the first oxygen concentration bias and the second oxygen concentration bias; and an oxygen concentration set value correction unit for correcting a set value of the concentration of oxygen by using the oxygen concentration bias.

9 Claims, 7 Drawing Sheets

(56) References Cited

FOREIGN PATENT DOCUMENTS

| | | | |
|---|---|---|---|
| KR | 10-2009-0067937 | A | 6/2009 |
| KR | 10-2009-0068810 | A | 6/2009 |
| KR | 10-2009-0069607 | A | 7/2009 |
| KR | 10-2010-0040469 | A | 4/2010 |
| KR | 10-2010-0074799 | A | 7/2010 |
| KR | 10-2011-0077619 | A | 7/2011 |
| KR | 10-1657415 | B1 | 9/2016 |
| KR | 10-2018-0071782 | A | 6/2018 |

* cited by examiner

PRIOR ART

APPARATUS AND METHOD FOR CONTROLLING CONCENTRATION OF OXYGEN IN HEATING FURNACE

CROSS-REFERENCE OF RELATED APPLICATIONS

This application is the U.S. National Phase under 35 U.S.C. § 371 of International Patent Application No. PCT/KR2017/015084, filed on Dec. 20, 2017, which in turn claims the benefit of Korean Patent Application No. 10-2016-0174801, filed Dec. 20, 2016, the entire disclosures of which applications are incorporated by reference herein.

TECHNICAL FIELD

The present disclosure relates to an apparatus and a method for controlling concentration of oxygen in a heating furnace.

BACKGROUND ART

Generally, in a heating furnace, an air-to-fuel ratio (hereinafter referred to as "AFR") needs to be appropriately adjusted to improve stability of combustion and efficiency of combustion. Accordingly, combustion control of the heating furnace is required.

FIG. 1 is a conceptual diagram illustrating combustion control of a heating furnace according to a related art.

FIG. 1 is based on scientific apparatus makers association (SAMA) notation. Referring to FIG. 1, combustion control of a heating furnace is performed by controlling a fuel supply amount through a fuel valve using a fuel flow rate set value 10 and a modified AFR and controlling an air supply amount through an air damper.

The modified AFR 20 was determined using the fuel flow rate set value 10 and an oxygen concentration set value set by a user, disclosed in detail in Korean Patent Publication No. 10-2009-0069607.

According to the invention disclosed in Korean Patent Publication No. 10-2009-0069607, an air flow rate is always maintained to be greater than a theoretically required air flow rate to prevent incomplete combustion, and thus, a safe combustion state may be maintained. However, heat loss was increased when an oxygen concentration set value, set by a user, was input as a certain value or more.

An AFR control technology was proposed to improve thermal efficiency of a heating furnace and to provide a flow rate of air within an appropriate combustion area, illustrated in FIG. 2.

FIG. 2 illustrates a configuration of an AFR control system of a heating furnace according to a related art.

FIG. 2 is based on scientific apparatus makers association (SAMA) notation. Referring to FIG. 2, an AFR control system of a heating furnace according to a related art includes a fuel flow rate setting part 21 for providing an oxygen concentration set value $O_2$sv by using a fuel flow rate set value and an oxygen concentration bias $O_2$_bias set by a user, an oxygen concentration control part 22 for providing an output ratio value $\beta_A$ by using the oxygen concentration set value $O_2$sv and an oxygen concentration measured value $O_2$pv, a carbon monoxide limiter adjustment part 23 for obtaining output limiting highest value/lowest value $\beta_H/\beta_L$ by using a carbon monoxide measured value of an exhaust gas, an highest value/lowest value limitation part 24 for limiting the output ratio value $\beta_A$ to the output limiting highest value/lowest value $\beta_H/\beta_L$, an output mode selection part 25 for selecting one of the output ratio value $\beta_A$, output from the above procedure, and a passive set ratio value $\beta_M$, and an AFR determination part 26 for obtaining a modified AFR by using the selected output ratio value.

This is disclosed in detail in Korean Patent Publication No. 10-2009-0068810.

In the AFR control system of a heating furnace according to a related art, since an oxygen concentration bias, set by a user, is directly used to set oxygen concentration, stable combustion may be maintained, while optimal combustion cannot be achieved, for example, carbon monoxide is out of an allowable range.

DISCLOSURE

Technical Problem

An aspect of the present disclosure is to provide an automatic correction method and a combustion control method for automatically controlling an oxygen ($O_2$) concentration set value by using carbon monoxide (CO) in a combustion control system of combustion equipment such as a heating furnace, or the like, and to provide a combustion control system.

Technical Solution

According to an aspect of the present disclosure, an apparatus for controlling the concentration of oxygen in a heating furnace includes: a first oxygen concentration bias setting unit configured to receive a set first oxygen concentration bias; a second oxygen concentration bias calculation unit configured to, when a measured value of carbon monoxide in exhaust gas is out of an allowable carbon monoxide range, calculate a second oxygen concentration bias based on the measured value of carbon monoxide and the concentration of oxygen measured in the exhaust gas; an oxygen concentration bias providing unit configured to provide an oxygen concentration bias based on the first oxygen concentration bias and the second oxygen concentration bias; and an oxygen concentration set value correction unit configured to correct a set value of the concentration of oxygen based on the oxygen concentration bias.

Advantageous Effects

According to an example embodiment in the present disclosure, in a combustion control system of combustion equipment such as a heating furnace, or the like, an oxygen concentration set value is automatically corrected and set while satisfying an allowable range of carbon monoxide in such a manner that optimal combustion may be maintained without operator's intervention. As a result, optimal combustion and significantly high thermal efficiency may be maintained.

BEST MODE FOR INVENTION

Figure 1:
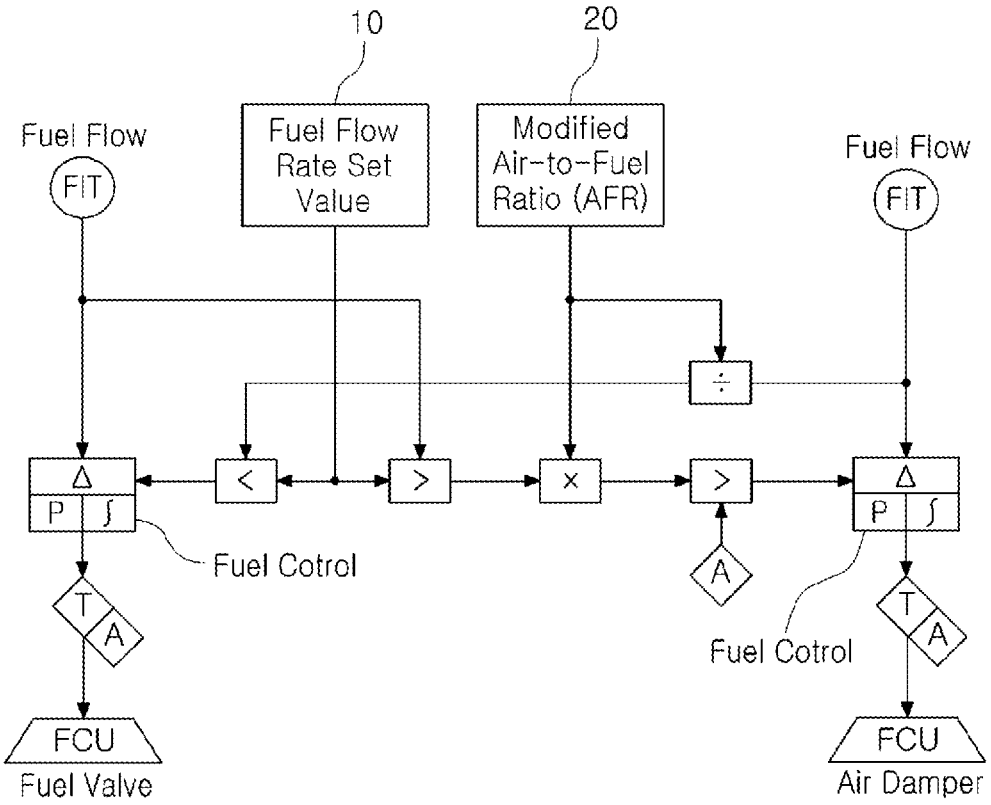
FIG. 1 is a conceptual diagram illustrating combustion control of a heating furnace according to a related art.
Figure 2:
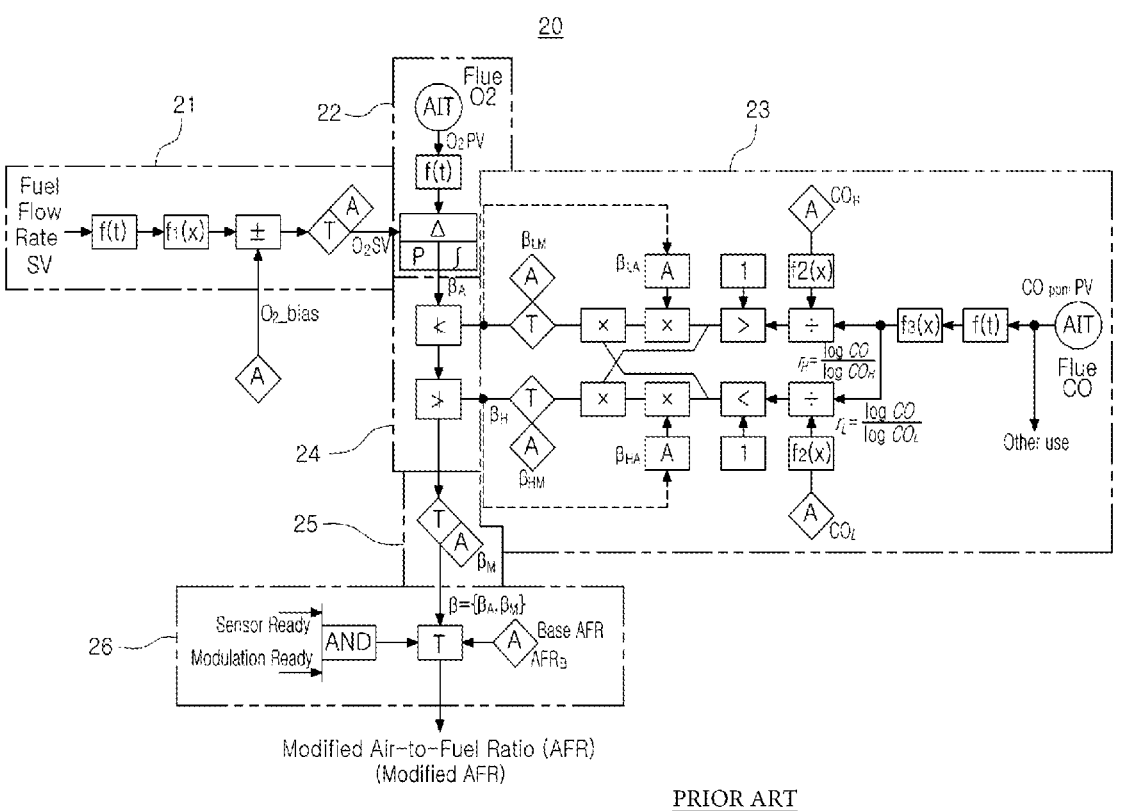
PRIOR ART Fig. 2
FIG. 2 illustrates a configuration of an air-to-fuel (AFR) control system of a heating furnace according to a related art.

Hereinafter, example embodiments in the present disclosure will be described in detail with reference to the accompanying drawings. The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. Throughout the drawings, the same or like reference numerals will be used to designate the same or like elements.

Figure 3:
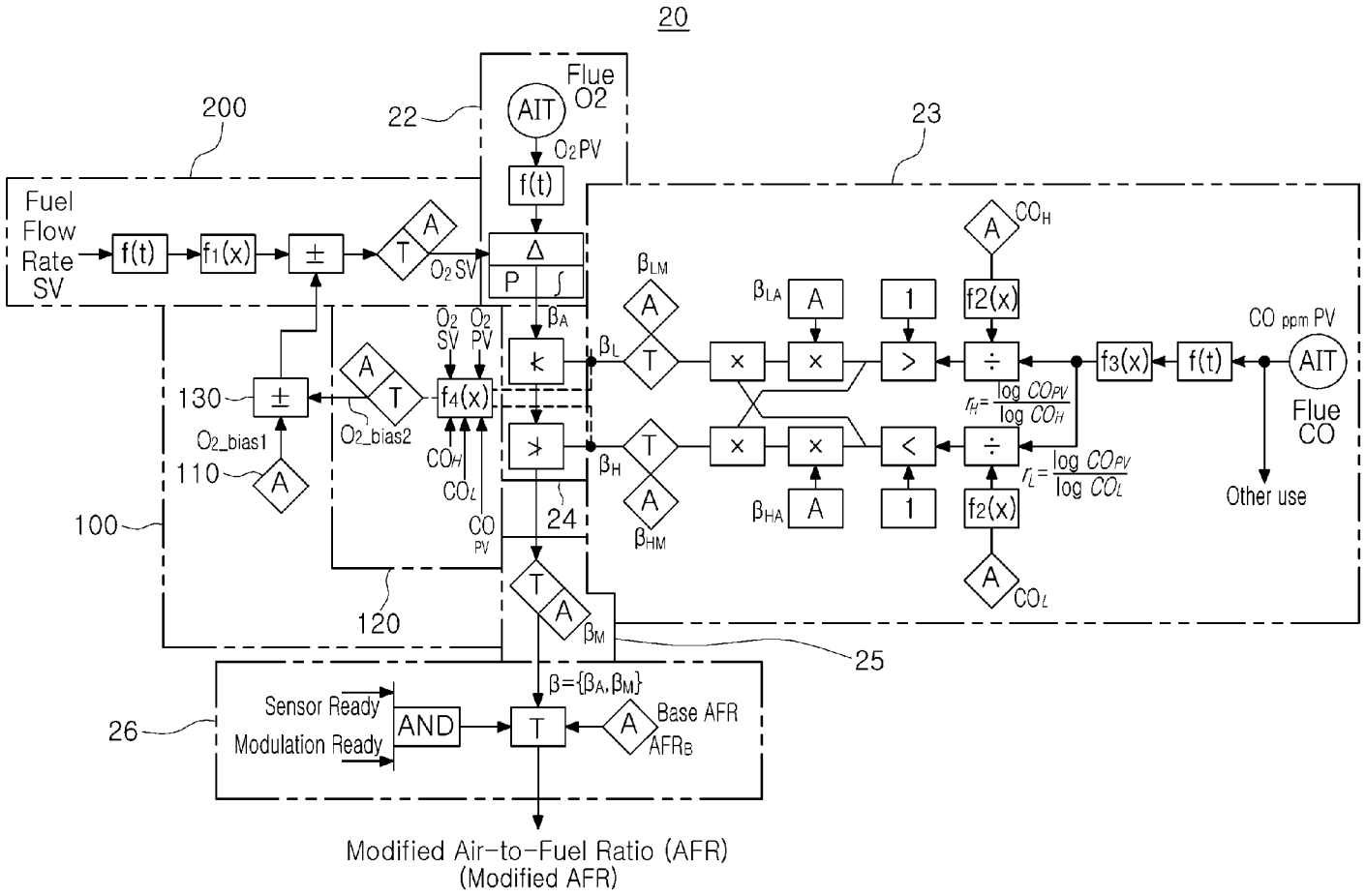
FIG. 3 illustrates an example of an apparatus for controlling oxygen concentration according to an example embodiment in the present disclosure.

FIG. 3 illustrates an example of an apparatus for controlling an oxygen concentration according to an example embodiment in the present disclosure.

FIG. 3 is based on scientific apparatus makers association (SAMA) notation. Referring to FIG. 3, an apparatus for controlling oxygen concentration according to an example embodiment may include an oxygen concentration bias ($O_2$_bias) correction unit 100 and an oxygen concentration set value correction unit 200.

The oxygen concentration bias ($O_2$_bias) correction unit 100 may include a first oxygen concentration bias setting unit 110, a second oxygen concentration bias calculation unit 120, and an oxygen concentration bias providing unit 130 to correct an oxygen concentration bias $O_2$_bias using a carbon monoxide measured value COpv of an exhaust gas.

Technical features of the present disclosure will be described with reference to FIG. 3, and descriptions of parts duplicated with a related art may be omitted because they are disclosed in Korean Patent Publication Nos. 10-2009-0069607 and 10-2009-0068810.

The first oxygen concentration bias setting unit 110 may be allowed to set a first oxygen concentration bias $O_2$_bias1. As an example, the first oxygen concentration bias $O_2$_bias1 may be set in advance by a user to correct an oxygen concentration set value.

As an example, even if the oxygen concentration set value is corrected only using the first oxygen concentration bias $O_2$_bias1 which may be set by a user, carbon monoxide in an exhaust gas maybe out of an allowable range. Therefore, a second oxygen concentration bias $O_2$_bias2 may be additionally used in the present disclosure, as set forth below.

The second oxygen concentration bias calculation unit 120 may calculate the second oxygen concentration bias $O_2$_bias2 by using the carbon monoxide measured value COpv and an oxygen concentration measured value $O_2$pv of an exhaust gas when the carbon monoxide measured value COpv of the exhaust gas is out of a carbon monoxide allowable range $CO_L$ to $CO_H$.

The carbon monoxide measured value COpv of the exhaust gas may be measured by a carbon monoxide sensor, the oxygen concentration measured value $O_2$pv may be measured by an oxygen sensor, and the carbon monoxide allowable range may be determined by a predetermined carbon monoxide lowest value $CO_L$ and a predetermined carbon monoxide highest value $CO_H$.

The oxygen concentration bias providing unit 130 may provide the oxygen concentration bias $O_2$_bias by using the first oxygen concentration bias $O_2$_bias1 from the first oxygen concentration bias setting unit 110 and the second oxygen concentration bias $O_2$_bias2 from the second oxygen concentration bias calculation unit 120.

As an example, the oxygen concentration bias providing unit 130 may calculate the oxygen concentration bias $O_2$_bias by adding the first oxygen concentration bias $O_2$_bias1 and the second oxygen concentration bias $O_2$_bias2.

The oxygen concentration set value correction unit 200 may correct an oxygen concentration set value $O_2$sv by using the oxygen concentration bias $O_2$_bias.

As an example, the oxygen concentration set value correction unit 200 may correct the oxygen concentration set value $O_2$sv by adding the oxygen concentration bias $O_2$_bias to a predetermined oxygen concentration set value $O_2$sv.

In FIG. 3, each of the oxygen concentration bias ($O_2$_bias) correction unit 100, the first oxygen concentration bias setting unit 110, the second oxygen concentration bias calculation unit 120, the oxygen concentration bias providing unit 130, and the oxygen concentration set value correction unit 200 may be implemented by coupling, for example, hardware such as a microprocessor, or the like, with software mounted on the hardware and programmed to perform a predetermined operation.

The hardware may include at least one processing unit and a memory. The processing unit may include at least one of, for example, a signal processor, a microprocessor, a central processing unit (CPU), an application specific integrated circuit (ASIC), and a field programmable gate array (FPGA).

The memory may include at least one of a volatile memory (for example, a random access memory (RAM), or the like) and a nonvolatile memory (for example, a read-only memory (ROM), a flash memory, or the like).

Redundant descriptions of components, having the same reference numeral and function, maybe omitted, related to each drawing of the present description.

Figure 4:
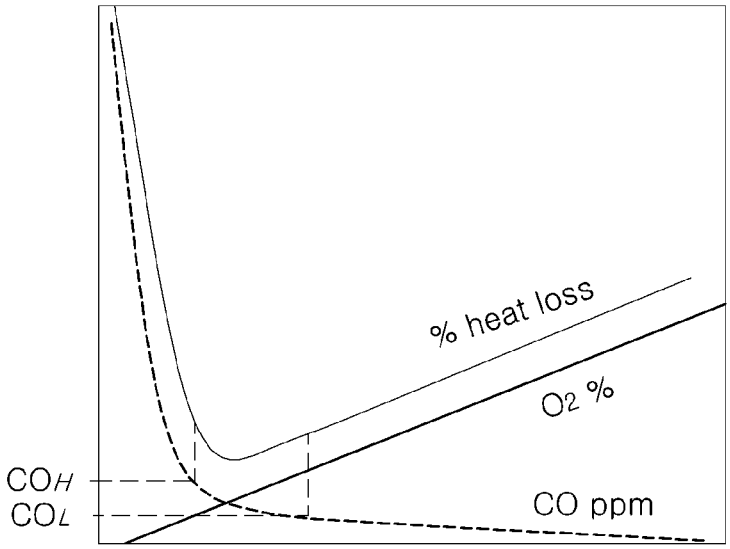
FIG. 4 is a graph illustrating heat loss depending on a relationship between concentrations of carbon monoxide and oxygen.

FIG. 4 is a graph illustrating heat loss depending on a relationship between concentrations of carbon monoxide and oxygen.

As can be seen from FIG. 4, in terms of combustion efficiency, a combustion state, in which an appropriate amount of carbon monoxide is contained in an exhaust gas, is more advantageous than in a state in which carbon monoxide is not substantially contained in an exhaust gas.

In addition, as can be seen from FIG. 4, an apparatus for controlling an oxygen concentration according to an example embodiment needs to perform oxygen control in such a manner that a lowest value $CO_L$ and a highest value of $CO_H$ of concentration of carbon monoxide are maintained in a combustion section in which heat loss is lowest.

Figure 5:
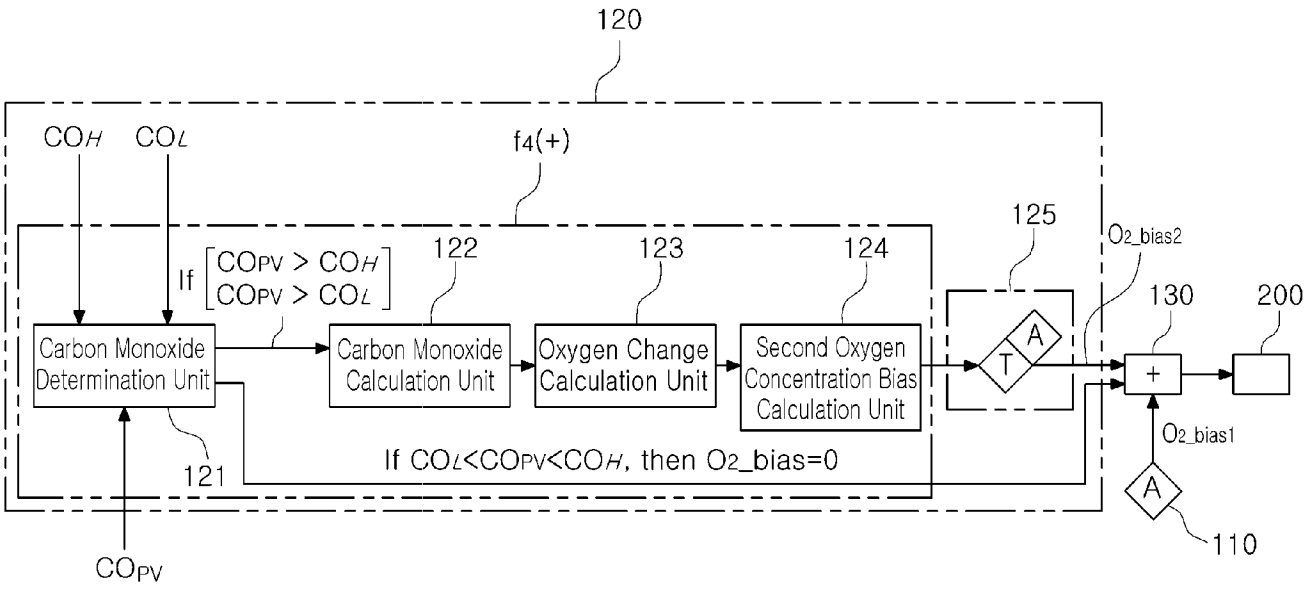
FIG. 5 illustrates an example of an internal block of the apparatus for controlling oxygen concentration in FIG. 3.

FIG. 5 illustrates an example of an internal block of the apparatus for controlling oxygen concentration in FIG. 3.

Referring to FIG. 5, the second oxygen concentration bias calculation unit 120 may include a carbon monoxide determination unit 121, a carbon monoxide calculation unit 122, an oxygen change calculation unit 123, and an oxygen concentration bias calculation unit 124.

The second oxygen concentration bias calculation unit 120 may further a signal transmission unit 125.

The carbon monoxide determination unit 121 may determine whether the carbon monoxide measured value COpv is out of a carbon monoxide allowable range $CO_L$ to $CO_H$.

As an example, the carbon monoxide determination unit 121 may not calculate when the carbon monoxide measured value COpv is not out of the carbon monoxide allowable range $CO_L$ to $CO_H$, and may calculate a second oxygen concentration bias $O_2$_bias through a procedure, set forth below, when the carbon monoxide measured value COpv is out of the carbon monoxide allowable range $CO_L$ to $CO_H$.

The carbon monoxide calculation unit 122 may calculate a moving average value COpv,avg(t) of the carbon monoxide measured value COpv.

As an example, the carbon monoxide calculation unit 122 may calculate a moving average value COpv,avg(t) of the carbon monoxide measured value COpv using Equation (1).

$$COpv,\ avg(t) = \frac{1}{N+1}\sum_{i=t}^{t-N} COpv(i) \qquad \text{Equation (1)}$$

where COpv,avg denotes a moving average value of the carbon monoxide measured value, N denotes a positive integer greater than or equal to 1, and t denotes a time variable.

The oxygen change calculation unit 123 may calculate an oxygen concentration change $\Delta O_2(t)$ using the moving average value COpv,avg(t) of the carbon monoxide measured value COpv and the oxygen concentration measured value $O_2$pv.

As an example, the oxygen change calculation unit 123 may calculate the oxygen concentration change $\Delta O_2(t)$ using Equation (2).

$$\Delta O_2(t) = A\frac{dO_2pv,\ avg}{dCOpv,\ avg}\Delta CO(t) + B \qquad \text{Equation (2)}$$

where A denotes a sensitivity coefficient, $\Delta O_2(t)$ denotes an oxygen concentration change, $dO_2$pv,avg denotes a differential value of moving average of an oxygen concentration measured value, dCOpv,avg denotes a differential value of moving average of the carbon monoxide measured value COpv, ΔCO(t) denotes a change of the carbon monoxide measured value Copy, and B denotes an offset for adjustment (for example, B=1).

The second oxygen concentration bias calculation unit 124 may calculate a second oxygen concentration via $O_2$_bias using the oxygen concentration change $\Delta O_2(t)$.

As an example, the second oxygen concentration bias calculation unit 124 may calculate the second oxygen concentration bias $O_2$_bias2 using Equation (3).

$$O_2_bias2 = O_2(t-1) + \Delta O_2(t) \qquad \text{Equation (3):}$$

where $O_2$_bias2 denotes a second oxygen concentration bias, $\Delta O_2$ (t) denotes an oxygen concentration change at a point of time (t), and $O_2$(T−1) denotes oxygen concentration at a point of time (t−1).

The signal transmission unit 125 may transmit the second oxygen concentration bias O2_*bias*2 from the second concentration bias calculation unit 124 to the oxygen concentration bias providing unit 130.

As an example, in FIG. 4, f4(*t*) is a function to calculate the second oxygen concentration bias $O_2$_bias2 using the carbon monoxide measured value COpv, as described above, and may include the carbon monoxide determination unit 121, the oxygen change calculation unit 123, and the second oxygen concentration bias calculation unit 124.

The second oxygen concentration bias calculation unit 120 may not provide the second oxygen concentration bias $O_2$_bias2 to the oxygen concentration bias providing unit 130 when the carbon monoxide measured value COpv is not out of the carbon monoxide allowable range $CO_L$ to $CO_H$, and may provide the second oxygen concentration bias $O_2$_bias2 to the oxygen concentration bias providing unit 130 through the procedure, set forth above, when the carbon monoxide measured value COpv is out of the carbon monoxide allowable range $CO_L$ to $CO_H$.

According to the above-described example embodiment, an oxygen concentration set value is automatically corrected using concentration of carbon monoxide to control oxygen concentration and an air-to-fuel ratio (AFR). Thus, concentration of carbon monoxide in an exhaust gas may be adjusted to a level to maintain optimal combustion of the concentration of carbon monoxide in the exhaust gas. As a result, optimal combustion and significantly high thermal efficiency may be maintained.

Hereinafter, a method for controlling oxygen concentration will be described with reference to FIGS. 3 to 7. In the present disclosure, description of the apparatus for controlling oxygen concentration and description of the method for controlling oxygen concentration may be complementarily applied unless context dictates otherwise.

Figure 6:
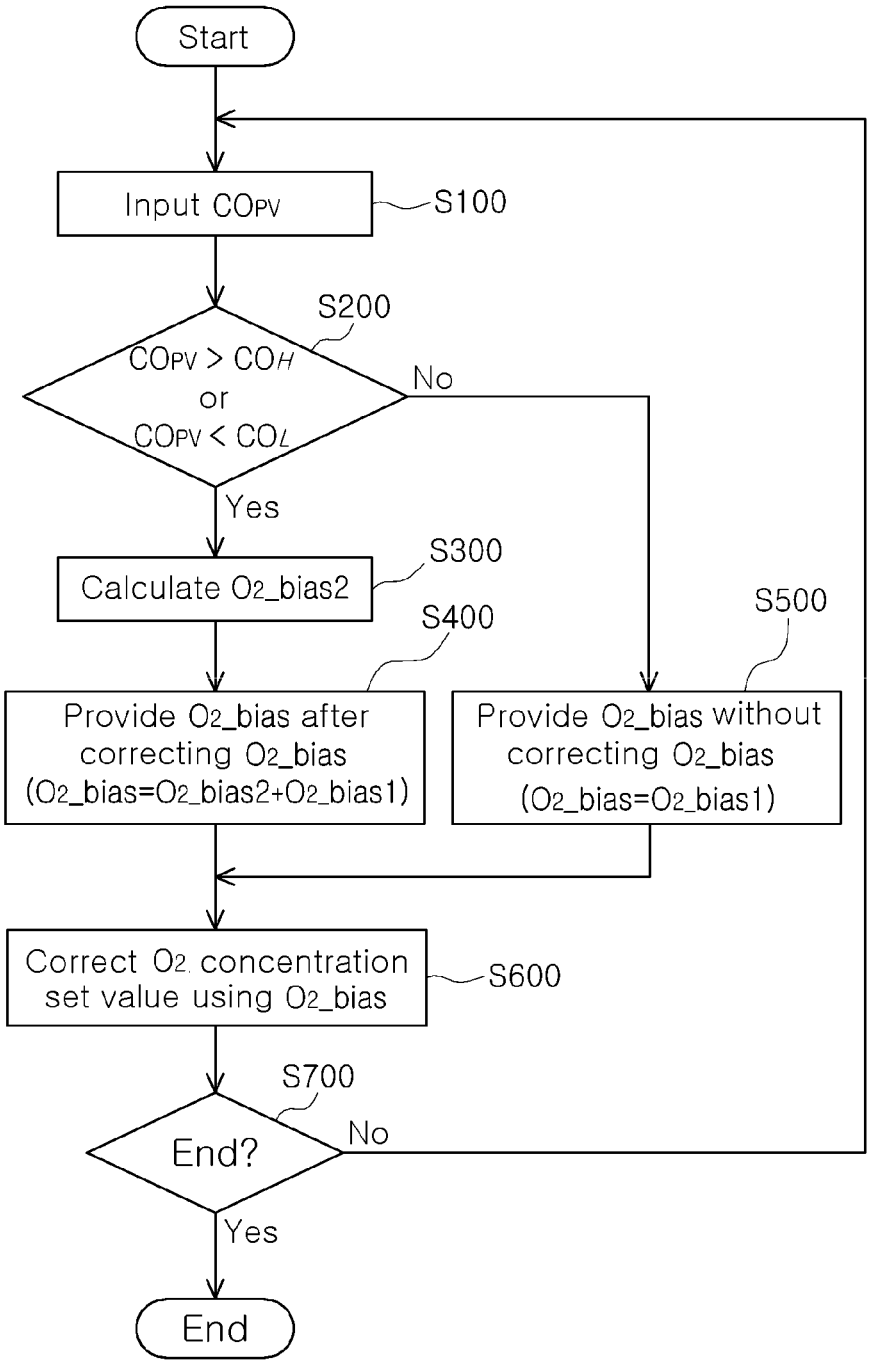
FIG. 6 illustrates an example of a method for controlling oxygen concentration according to an example embodiment in the present disclosure.

FIG. 6 illustrates an example of a method for controlling oxygen concentration according to an example embodiment in the present disclosure.

Referring to FIGS. 3 to 6, in operation S100, a carbon monoxide measured value COpv of an exhaust gas may be input by a first oxygen concentration bias setting unit 110.

In operation S200, a determination may be made by a second oxygen concentration bias calculation unit 120 as to whether the carbon monoxide measured value COpv is out of a carbon monoxide allowable range $CO_L$ to $CO_H$.

In operation S300, a second oxygen concentration bias $O_2$_bias2 may be calculated by the second oxygen concentration bias calculation unit 120 using the carbon monoxide measured value COpv and an oxygen concentration measured value $O_2$pv of the exhaust gas.

In operation S400, an oxygen concentration bias $O_2$_bias maybe calculated by an oxygen concentration bias providing unit 130 using the first oxygen concentration bias $O_2$_bias1 and the second oxygen concentration bias $O_2$_bias2 when the carbon monoxide measured value COpv is out of the carbon monoxide allowable range $CO_L$ to $CO_H$.

In operation S500, the first oxygen concentration bias $O_2$_bias1 may be provided as the oxygen concentration bias $O_2$_bias when the carbon monoxide measured value COpv is not out of the carbon monoxide allowable range $CO_L$ to $CO_H$.

In operation S600, an oxygen concentration set value $O_2$sv maybe corrected by an oxygen concentration set value correction unit 200 using the oxygen concentration bias $O_2$_bias.

The oxygen concentration set value $O_2$sv, corrected through the above-described procedure, may be used in oxygen control and AFR correction to maintain optimal combustion.

Figure 7:
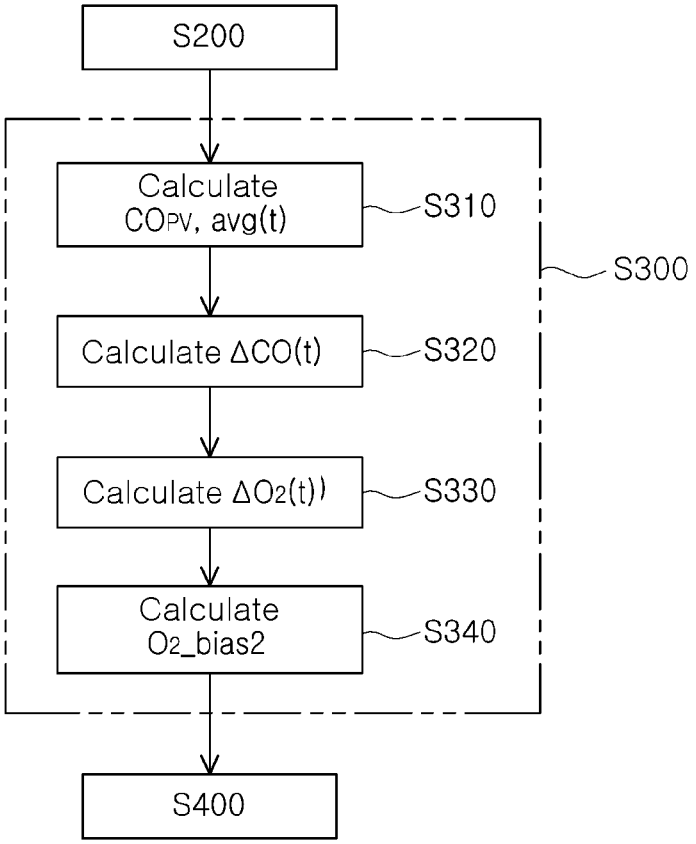
FIG. 7 illustrates an example of a calculation flow of an oxygen concentration bias in FIG. 6.

FIG. 7 illustrates an example of a calculation flow of an oxygen concentration bias in FIG. 6.

Hereinafter, the operation S300, in which the second oxygen concentration bias $O_2$_bias2 is calculated, will be described with reference to FIGS. 3 to 7.

In operation S310, a moving average value COpv,avg(t) of the carbon monoxide measured value COpv may be calculated based on Equation (1).

In operation S320, a carbon monoxide change ΔCO(t) may be calculated based on Equation (4) using the moving average value COpv,avg(t) of the carbon monoxide measured value COpv.

$$\Delta CO(t)=CO_{pv,avg}(t-1)-CO_{pv,avg}(t) \quad \text{Equation (4):}$$

where COpv,avg(t−1) denotes a moving average value of the carbon monoxide measured value COpv at a point of time (t−1), and COpv,avg(t) denotes a moving average value of the carbon monoxide measured value COpv at a point of time (t).

In operation S330, an oxygen concentration change $\Delta O_2$(t) may be calculated based on Equation (2) using the moving average value COpv,avg(t) of the carbon monoxide measured value COpv, the oxygen concentration measured value $O_2$pv, and the carbon monoxide change ΔCO(t).

In operation S340, a second oxygen concentration bias $O_2$_bias2 may be calculated based on Equation (3) using the oxygen concentration change $\Delta O_2$(t).

The invention claimed is:

1. An apparatus for controlling oxygen concentration in a heating furnace, the apparatus comprising:

a first oxygen concentration bias setting unit configured to receive a set first oxygen concentration bias;

a second oxygen concentration bias calculation unit configured to, when a measured value of carbon monoxide in exhaust gas is out of an allowable carbon monoxide range, calculate a second oxygen concentration bias based on the measured value of carbon monoxide and the concentration of oxygen measured in the exhaust gas;

an oxygen concentration bias providing unit configured to obtain and provide a third oxygen concentration bias by adding the first oxygen concentration bias and the second oxygen concentration bias; and an oxygen concentration set value correction unit configured to correct an oxygen concentration set value by adding the third oxygen concentration bias to a predetermined oxygen concentration set value, wherein the second oxygen concentration calculation unit comprises:

a carbon monoxide determination unit configured to determine whether the measured value of carbon monoxide is out of the allowable carbon monoxide range;

a carbon monoxide calculation unit configured to calculate a moving average value of the measured value of carbon monoxide;

an oxygen change calculation unit configured to calculate an oxygen concentration change based on the moving average value of the measure value of carbon monoxide and the measured value of oxygen concentration; and a second oxygen concentration bias calculation unit configured to calculate a second oxygen concentration bias based on the oxygen concentration change, and the second oxygen concentration calculation unit is configured not to provide a second oxygen concentration bias when the measured value of carbon monoxide is not out of the carbon monoxide allowable range and configured to provide the second oxygen concentration bias when the measured value of carbon monoxide is out of the carbon monoxide allowable range.

2. The apparatus of claim 1, wherein the carbon monoxide calculation unit is configured to calculate the moving average value of the measured value of carbon monoxide using an equation below, $$COpv,\ avg(t) = \frac{1}{N+1}\sum_{i=t}^{t-N} COpv(i)$$

where COpv,avg denotes a moving average value of the carbon monoxide measured value, N denotes a positive integer greater than or equal to 1, and t denotes a time variable.

3. The apparatus of claim 1, wherein the oxygen change calculation unit is configured to calculate the oxygen concentration change using an equation below, $$\Delta O_2(t) = A\frac{dO_2pv,\ avg}{dCOpv,\ avg}\Delta CO(t) + B$$

where $\Delta O_2$(t) denotes an oxygen concentration change, A denotes a sensitivity coefficient, $dO_2$pv,avg denotes a differential value of moving average of an oxygen concentration measured value, dCOpv,avg denotes a differential value of moving average of the carbon monoxide measured value, ΔCO(t) denotes a change of the carbon monoxide measured value COpv, and B denotes an offset for adjustment.

4. The apparatus of claim 1, wherein the second oxygen concentration bias calculation unit is configured to calculate the second oxygen concentration bias using an equation below, $$O_2_bias2=O_2(t-1)+\Delta O_2(t)$$

where $O_2$_bias2 denotes a second oxygen concentration bias, $\Delta O_2$(t) denotes an oxygen concentration change at a point of time (t), and $O_2$(T−1) denotes oxygen concentration at a point of time (t−1).

5. A method for controlling oxygen concentration of a heating furnace, the method comprising:

receiving a measured value of carbon monoxide in exhaust gas determining whether the measured value of carbon monoxide is out of an allowable carbon monoxide range;

calculating a second oxygen concentration bias based on the measured value of carbon monoxide and a measured value of oxygen concentration in the exhaust gas;

calculating a third oxygen concentration bias by adding the first oxygen concentration bias and the second oxygen concentration bias when the measured value of carbon monoxide is out of the allowable carbon monoxide range;

providing the first oxygen concentration bias as the third oxygen concentration bias when the measured value of carbon monoxide is not out of the allowable carbon monoxide range; and correcting an oxygen concentration set value by adding the third oxygen concentration bias to a predetermined oxygen concentration set value, wherein the calculating a second oxygen concentration bias comprises:

calculating a moving average value of the measured value of carbon monoxide;

calculating a carbon monoxide change based on the moving average value of the measured value of carbon monoxide;

calculating an oxygen concentration change based on the moving average value of the measured value of carbon monoxide, the measured value of the oxygen concentration, and the carbon monoxide change; and calculating a second oxygen concentration bias of the oxygen concentration change.

6. The method of claim 5, wherein in the calculating a moving average value, the moving average value of the measured value of carbon monoxide is calculated using an equation below, $$COpv,\ avg(t) = \frac{1}{N+1}\sum_{i=t}^{t-N} COpv(i)$$

where COpv,avg denotes a moving average value of the carbon monoxide measured value, N denotes a positive integer greater than or equal to 1, and t denotes a time variable.

7. The method of claim 5, wherein in the calculating a carbon monoxide change, the carbon monoxide change is calculated using an equation below, $$\Delta CO(t) = COpv,avg(t-1z) - COpv,avg(t)$$

where COpv,avg (t−1) denotes a moving average value of the carbon monoxide measured value COpv at a point of time (t−1), and COpv,avg(t) denotes a moving average value of the carbon monoxide measured value COpv at a point of time (t).

8. The method of claim 5, wherein in the calculating an oxygen concentration change, the oxygen concentration change is calculated using an equation below, $$\Delta O_2(t) = A\frac{dO_2pv,\ avg}{dCOpv,\ avg}\Delta CO(t) + B$$

where $\Delta O_2(t)$ denotes an oxygen concentration change, A denotes a sensitivity coefficient, $dO_2pv,avg$ denotes a differential value of moving average of an oxygen concentration measured value, dCOpv,avg denotes a differential value of moving average of the carbon monoxide measured value, ΔCO(t) denotes a change of the carbon monoxide measured value Copy, and B denotes an offset for adjustment.

9. The method of claim 5, wherein in the calculating a second oxygen concentration bias, the second oxygen concentration bias is calculated using an equation below, $$O_2_bias2 = O_2(t-1) \pm \Delta O_2(t)$$

where $O_2$_bias2 denotes a second oxygen concentration bias, $\Delta O_2(t)$ denotes an oxygen concentration change at a point of time (t), and $O_2(T-1)$ denotes oxygen concentration at a point of time (t−1).

* * * * *